US005461391A

United States Patent [19]

Ohnishi et al.

[11] Patent Number: 5,461,391

[45] **Date of Patent: * Oct. 24, 1995**

[54] AUTOMOTIVE WINDOW GLASS ANTENNA

[75] Inventors: Masahiro Ohnishi, Isehara; Yoji Nagayama; Shingo Tadokoro, both of Matsusaka, all of Japan

[73] Assignee: Central Glass Company, Limited, Yamaguchi Prefecture, Japan

[ * ] Notice: The portion of the term of this patent subsequent to Aug. 2, 2011 has been disclaimed.

[21] Appl. No.: 131,550

[22] Filed: Oct. 5, 1993

[30] Foreign Application Priority Data

| | | | |
|---|---|---|---|
| Oct. 6, 1992 | [JP] | Japan | 4-267155 |
| Nov. 27, 1992 | [JP] | Japan | 4-318907 |

[51] Int. Cl.[6] ..... H01Q 1/32

[52] U.S. Cl. ..... 343/713; 343/704

[58] Field of Search ..... 343/713, 704; H01Q 1/32, 1/02

[56] References Cited

U.S. PATENT DOCUMENTS

| | | | |
|---|---|---|---|
| 5,334,989 | 8/1994 | Nagayama et al. | 343/713 |

FOREIGN PATENT DOCUMENTS

| | | | |
|---|---|---|---|
| 0411963 | 2/1991 | European Pat. Off. . | |
| 0418047 | 3/1991 | European Pat. Off. . | |
| 3921413 | 3/1990 | Germany . | |
| 58-196702 | 11/1983 | Japan . | |
| 61-00004 | 5/1986 | Japan | H01Q 1/32 |
| 62-37475 | 2/1987 | Japan . | |
| 63-43403 | 2/1988 | Japan . | |
| 1-106502 | 4/1989 | Japan | H01Q 1/32 |
| 2-94904 | 4/1990 | Japan . | |
| 2-218202 | 8/1990 | Japan . | |
| 3-65803 | 3/1991 | Japan | H01Q 1/32 |
| 3-128503 | 5/1991 | Japan | H01Q 1/32 |
| 3-254205 | 11/1991 | Japan | H01Q 1/32 |
| 4-10801 | 1/1992 | Japan | H01Q 1/32 |
| 2184292 | 6/1987 | United Kingdom . | |

*Primary Examiner*—Donald Hajec
*Assistant Examiner*—Hoanganh Le
*Attorney, Agent, or Firm*—Keck, Mahin & Cate

[57] ABSTRACT

A second antenna is provided to a vehicle rear window glass in order to prevent a fall or dip of the gain of the antenna system in a particular direction or directions, thereby improving the directivity characteristic and increasing the gain. The second antenna consists of a feed point and a pair of first and second elements connected to the feed point. The first element has, in an area of the space above a first antenna or in a space defined between the upper and lower ends of a first antenna, at least one horizontal conductive strip. In one embodiment, in which the feed point is arranged in a marginal area of the space under the defogging heater element, the first element further has a vertical conductive strip arranged in an area of the space between the heater element and a lateral edge of the window glass. The second element is arranged in an area of the space under the defogging heater element and made up of a conductive strip assembly of various shapes such as ⊐-shape, a rectangular loop or loops, or a T-shape. The second element is connected to a bus bar or a heating strip of the defogging heater element in order to further increase the gain of the antenna system in all directions.

11 Claims, 6 Drawing Sheets

AUTOMOTIVE WINDOW GLASS ANTENNA

BACKGROUND OF THE INVENTION

1. Field of the Invention

The present invention relates to a glass antenna installed in or on a window glass of an automobile for receiving a radio frequency signal from a portable radio transmitter for controlling the operation of automotive equipment such as a keyless entry system for automatically unlocking a vehicle door, a similar control system for a luggage compartment lid, a control system for controlling turning on and off of a passenger compartment lamp, etc.

2. Disclosure Information

A keyless entry system for automatically unlocking a vehicle door by receiving a radio frequency signal of a frequency around 40 MHz, 60 MHz, 250 MHz or 300 MHz emitted from a radio transmitter has lately come to attract considerable attention.

In a keyless entry system disclosed in Japanese Provisional Patent Publication No. 62-37475, a pick-up consisting of a loop coil built in a vehicle pillar is used as an antenna. A problem of such a prior art antenna is that it is largely influenced by noise. Another problem is that the antenna is embedded in a vehicle body, so that its tuning cannot be attained with ease.

A glass antenna consisting of conductive strips formed on a lower marginal portion of a side window glass by screen printing has been proposed for use in such a keyless entry system as disclosed in Japanese Provisional Publication No. 63-43403. A problem of this glass antenna is that opening and closing of the window causes variations in its gain, so that during opening of the window the gains in some directions become so small as to cause malfunction of the keyless entry system.

It has further been proposed to install an antenna for a keyless entry system in or on a rear window glass. However, most of the rear window glass is used for installation of the heating element for a defogger, and in may cases an upper marginal part above the heater element or the like part is used for installation of an antenna for receiving TV broadcast waves. For this reason, an antenna for a keyless entry system is subjected to arrangement restrictions and has been incapable of attaining a sufficiently large gain when simply installed in or on a remaining marginal part of the rear window glass.

It has yet further been proposed to install an antenna for receiving FM radio and TV broadcast waves an unoccupied area of a heater element installed in part of a rear window glass as disclosed in Japanese Patent Provisional Publication No. 2-94904 or to connect a feed point of an antenna, which is installed on a marginal part of a rear window glass under a heater element for receiving FM radio and TV broadcast waves, to a bus bar as disclosed in Japanese Patent Provisional Publication No. 1-106502. However, even if such an antenna is used for a keyless entry system, a fall or dip of gain in a particular direction will inevitably be caused, and therefore such an antenna cannot be put into practical use for a keyless entry system.

SUMMARY OF THE INVENTION

According to an aspect of the present invention, there is provided a novel and improved antenna system attached to a vehicle rear window glass for receiving radio waves. The window glass is provided with a defogging heater element so as to leave a space around the heater element. The antenna system comprises a first antenna arranged in an area of the space above the defogging heater element and having a horizontal conductive strip and a vertical conductive strip, a second antenna having a feed point arranged in a widthwise marginal area of the space under the defogging heater element, and a pair of first and second elements connected to the feed point. The first element has a vertical conductive strip arranged in an area of the space between the defogging heater element and a lateral edge of the window glass, and a horizontal conductive strip arranged in an area of the space above the first antenna or in an area of the space defined between the upper and lower ends of the first antenna. The second element is arranged in an area of the space under the defogging heater element. The antenna system further comprises conductive strip means for providing electrical connection between the defogging heater element and the second antenna.

According to another aspect of the present invention, the feed point is arranged in an area of the space above the defogging heater element. The first element has a horizontal conductive strip arranged in an area of the space above the first antenna or in an area of the space defined between the upper and lower ends of the first antenna. The second element has a vertical conductive strip arranged in an area of the space between the defogging heater element and a lateral edge of the window glass, and a horizontal conductive strip arranged in an area of the space under the defogging heater element.

According to a further aspect of the present invention, the second element comprises a pair of horizontal conductive strips, a vertical conductive strip connecting one end of each of the horizontal conductive strips of the second element, and a generally horizontal conductive strip extending upward from one of the horizontal conductive strips of the second element and then extending horizontally toward a lateral end of the window glass.

According to a further aspect of the present invention, the second element comprises a plurality of horizontal conductive strips having the length of $0.02\ \lambda\ f^{1/2}\ (1\pm0.2)$ where f is the frequency of a radio wave to be received by the antenna and $\lambda$ is the wavelength of the radio wave. The number of the horizontal conductive strips are in the range from two to four, and adjacent horizontal conductive strips are connected at opposite ends by vertical conductive strips so as to constitute a rectangular loop.

According to a further aspect of the present invention, the second element comprises a first generally horizontal conductive strip connected to the feed point and extending horizontally away therefrom to have a bent end, and a second generally horizontal conductive strip connected to the bent end of the first horizontal conductive strip of the second element and extending horizontally toward a lateral end of the window glass.

According to a further aspect of the present invention, the second element comprises a T-shaped conductive strip assembly and a horizontal conductive strip connected to a vertical conductive strip of the T-shaped conductive strip assembly and extending horizontally away therefrom.

According to a further aspect of the present invention, the second element comprises two horizontal conductive strips which are connected at first ends by a vertical conductive strip, and a horizontal conductive strip connected to the vertical conductive strip of the second element and extending horizontally away therefrom.

The second antenna, consisting of the above described first and second elements, can increase the effective area of the antenna and the height thereof above the ground, thus making it possible to increase the gain in all directions.

The second element changes the tuning frequency and the impedance so as to increase the transfer ratio and is therefore contributive to increase of the gain. Further, by connecting the bus bar or the heating strip of the defogging heater element to a second antenna, i.e., the feed point or to the first element thereof, a dip or fall of the gain in a particular direction or directions can be eliminated or at least reduced as compared with such an antenna system in which the bus bar or the heating strip is not connected to the second antenna, thus making it possible to further increase the gain in all directions by at least 1~2 dB.

Further, the feed point arranged above the defogging heater element is effective for further increasing the gain since it is placed in a higher position and in a position of a larger electric current density. However, the feed point arranged under the defogging heater element is still practically useful since the antenna system with such a feed point can function properly in use for a keyless entry system and does not cause any substantial problem. An advantage of the feed point arranged under the defogging heater element is that a higher work efficiency can be attained since the feed points for the first and second antennas are arranged above and under the defogging heater element separately and a shorter wiring length can be attained when a control unit for a keyless entry system is disposed on a luggage compartment lid.

Further, it is desirable to arrange the horizontal conductive strip of the first element in an area of the space above the first antenna than in an area of the space defined between the upper and lower ends of the first antenna since it can be arranged in a place of a larger electric current density. However, when the distance between the horizontal conductive strip of the first element and an edge of a vehicle body defining a rear window glass opening is smaller than 10 mm, a reduced gain will result since the horizontal conductive strip of the first element is too close to the vehicle body serving as an earth. On the other hand, when the distance between the horizontal conductive strip of the first element and the first antenna is smaller than 15 mm, the first and second antennas will interfere with each other. Thus, the first element should be arranged so that the distance between its horizontal conductive strip and the edge of the vehicle body defining the window opening is 10 mm or more, and that the distance between its horizontal conductive strip and the first antenna is 15 mm or more.

It is accordingly an object of the present invention to provide an antenna system which can attain an improved directivity characteristic and an increased gain in all directions.

DETAILED DESCRIPTION OF THE PREFERRED EMBODIMENTS

Figure 1:
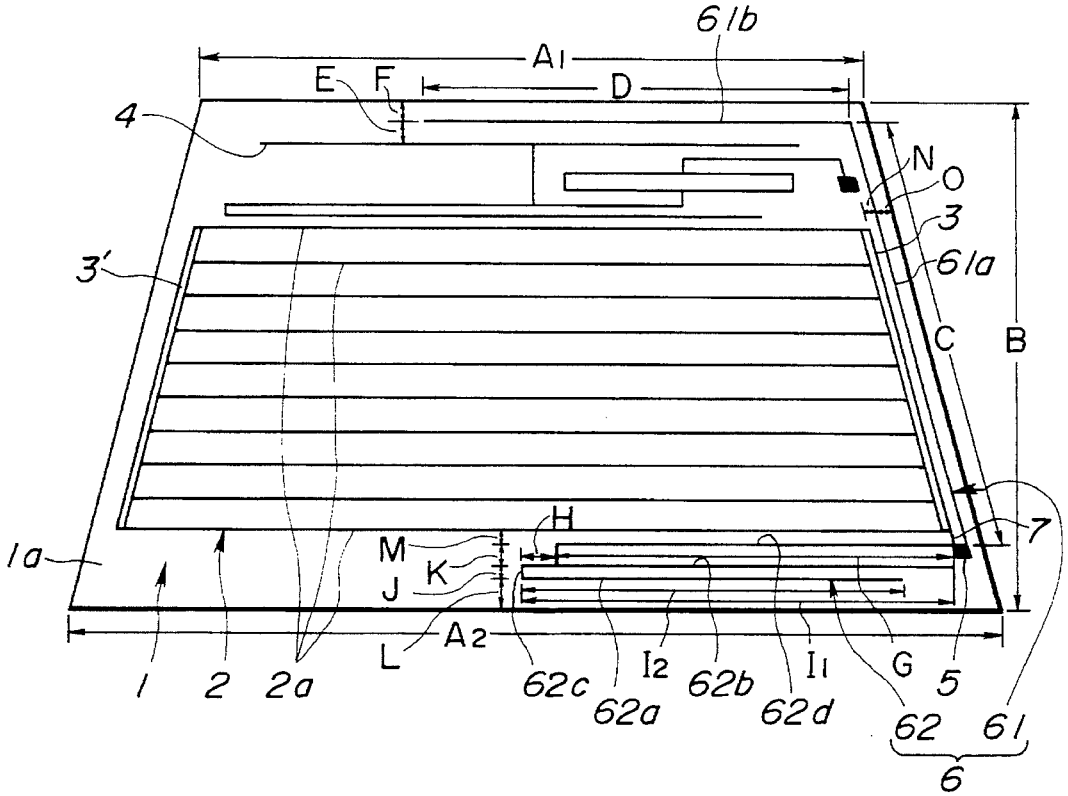
FIGS. 1 to 12 are front views of various embodiments of a glass antenna for an automobile according to the present invention.

Referring first to FIG. 1, a rear window glass 1 of an automobile has on an inboard surface thereof a defogging electric heater element 2 consisting of a plurality of heating strips 2*a* and a pair of bus bars 3 and 3', and a conventional first antenna 4 consisting of horizontal conductive strips and a vertical conductive strip. The window glass 1 has a space la around the heater element 2. The first antenna 4 is arranged in an area of the space 1*a* above the heater element 2, i.e., between the upper edge of the window glass 1 and the heater element 2.

A second antenna 6 consists of a feed point 5, and a pair of first and second elements 61 and 62. The feed point 5 is arranged in a widthwise marginal area of the space 1*a* under one bar 3. The first element is made up of a vertical conductive strip 61*a* arranged in an area of the space 1*a* between one of the bus bars 3 and a lateral edge of the window glass 1 and has a lower end connected to the feed point 5, and a horizontal conductive strip 61*b* arranged in an area of the space 1*a* above the heater element 2 or more specifically between the upper edge of the window glass 1 and the first antenna 4 and connected to the upper end of the vertical conductive strip 61*a*.

The second element 62 consists of a nearly ⊐-shaped portion made up of two horizontal conductive strips 62*a*, 62*b* and a vertical conductive strip 62*c* connecting first ends of the horizontal conductive strips 62*a* and 62*b*, and a generally horizontal conductive strip 62*d* extending upward from the upper horizontal conductive strip 62*b* and then horizontally toward the feed point 5 for connection between them.

In addition to the first and second antennas 4 and 6, there is provided a conductive strip 7 which connects the feed point 5 to the bus bar 3.

The first and second elements 61 and 62 of the second antenna 6, and the conductive strip 7 are formed by screen-printing a conductive paste on the window glass 1 and baking the printed paste.

The various parts of the second antenna 6 have such dimensions that A1=1000 mm, A2=1400 mm, B=750 mm, C=600 mm, D=650 mm, E=30 mm, F=20 mm, G=650 mm, H=50 mm, I1=700 mm, I2=650 mm, J=20 mm, K=20 mm, L=65 mm, M=10 mm, N=10 mm and O=20 mm, With an automotive glass antenna such as that shown in FIG. 1, directivity characteristics were measured by measuring the gains in various directions with respect to FM wave of a frequency of 60 MHz and having a horizontal plane of polarization and expressed by the difference in gain between the antenna of this embodiment and a standard dipole antenna on the assumption that the gain of the dipole antenna is zero (hereinafter the difference is referred to as a dipole ratio), to depict the directivity characteristic. The result was that the gains measured every five degrees (i.e., in seventy-two directions) were larger than −25 dB (minimum gain was −22.8 dB), and the average of the gains in the seventy-two directions was −15.3 dB. Since the gain necessary for automatic control of an automotive door or for similar automatic control of other automotive equipment is about −25 dB, the antenna of this embodiment can operate them properly by receiving a radio frequency signal from any direction.

Figure 2:
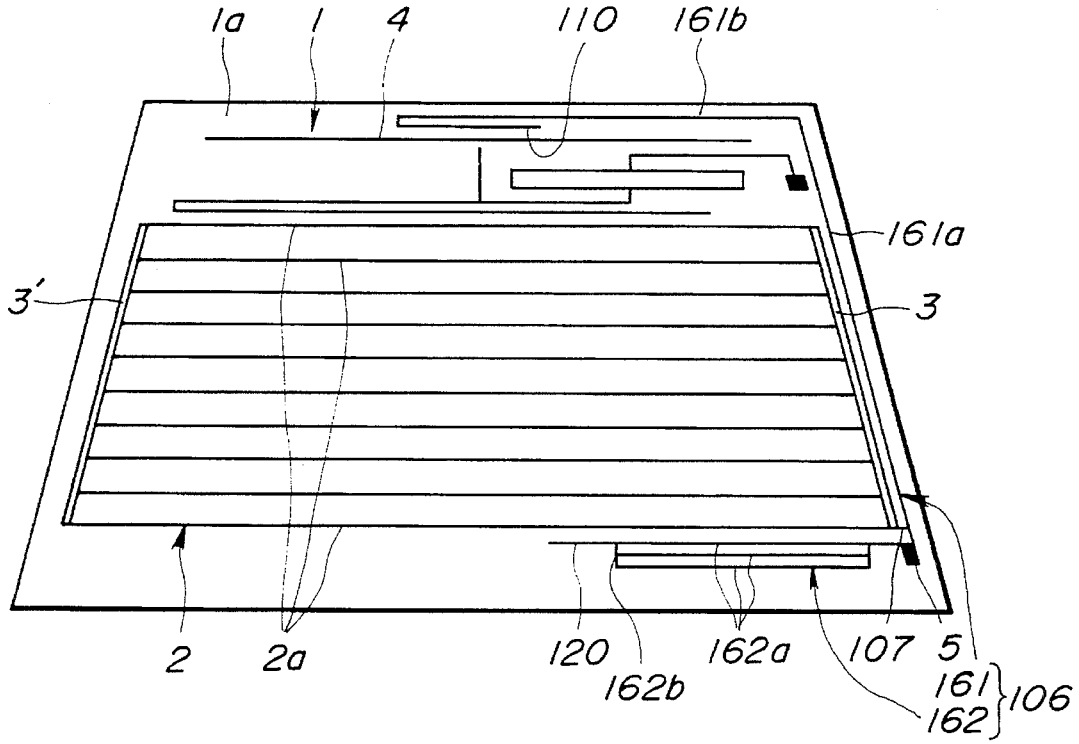

FIG. 2 shows a further embodiment which differs from the previous embodiment of FIG. 1 in that the first element 161 further includes an auxiliary element 110 made up of a generally horizontal conductive strip having a horizontal length of 200 mm, disposed between the horizontal strip 161*b* and the first antenna 4 and connected at a vertically bent end to an end of the horizontal conductive strip 161*b* located more remote from the vertical conductive strip 161*a*. The second element 162 consists of three horizontal conductive strips 162*a* of a length of 400 mm, arranged at vertical intervals of 10 mm and connected at opposite ends by vertical conductive strips 162*b* to constitute two rectangular loops which are vertically continuous to each other. The second antenna further includes an auxiliary element 120 made up of a generally horizontal conductive strip and connected to the looped conductive strip assembly 162*a* and 162*b*, and the conductive strip 107 connects the first element 161 to one bus bar 3.

With an automotive glass antenna such as that shown in FIG. 2, the gains in various directions with respect to FM wave of a frequency of 250 MHz and having a horizontal plane of polarization were measured and expressed by the above mentioned dipole ratio to depict the directivity characteristic. The result was that all the gains measured every five degrees (i.e., in the seventy-two directions) were larger than −25 dB (minimum gain was −22.4 dB), and the average of the gains in the seventy-two directions was −15.9 dB. This embodiment thus can function properly with respect to a radio wave from any direction and therefore can produce substantially the same effect to the previous embodiment of FIG. 1.

Figure 3:
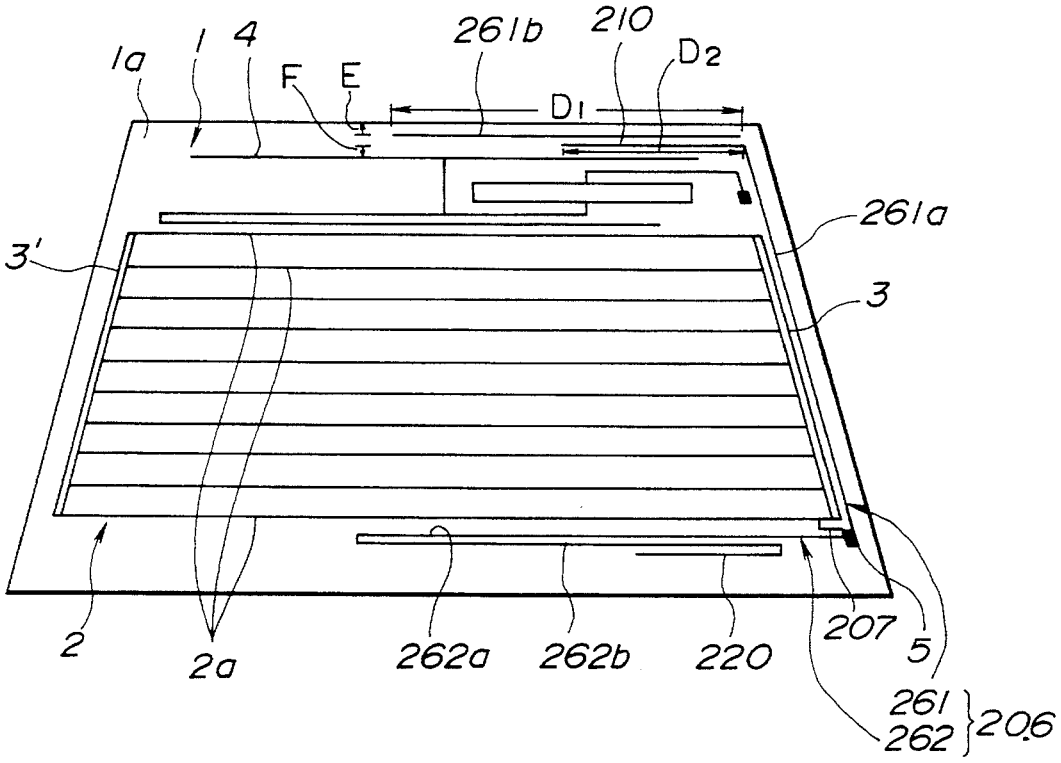

FIG. 3 shows a further embodiment which differs from the previous embodiment of FIG. 1 in that the horizontal conductive strip 261*b* of the first element 261 has a length D1 of 600 mm. The first element 261 further includes an auxiliary element 210 of the length D2 of 300 mm, the auxiliary element 210 being connected at one end to the vertical conductive strip 261*a*. The horizontal conductive strip 261*b* and the auxiliary element 210 are arranged such that E=15 mm and F=15 mm. The second element 262 includes a first generally horizontal conductive strip 262*a* of the horizontal length of 800 mm, the first horizontal conductive strip 262*a* being connected to the feed point 5 and extending away therefrom toward the widthwise center of the window glass 1 to have a downwardly bent end. The second element 262 further includes a second generally horizontal conductive strip 262*b* of the horizontal length of 700 mm, the second horizontal conductive strip 262*b* being connected to the downwardly bent end of the first horizontal conductive strip 262*a* and extending away therefrom toward a lateral end of the window glass 1 to have a downwardly bent end. The second element 262 further includes an auxiliary element 220 made up of a horizontal conductive strip of the length of 200 mm and connected to the downwardly bent end of the second horizontal conductive strip 262*b* so as to extend away therefrom toward the widthwise center of the window glass 1. The conductive strip 207 connects the lowest heating strip 2*a* of the heater element to the feed point 5.

With an automotive glass antenna such as that shown in FIG. 3, the gains in various directions with respect to an FM wave of a frequency of 60 MHz and having a horizontal plane of polarization were measured and expressed by the above mentioned dipole ratio to represent the directivity characteristic. The result was that the average of gains in the seventy-two directions was −16.8 dB, and the minimum gain was −23.1 dB. This embodiment thus can function properly with respect to a radio wave from any direction and therefore can produce substantially the same effect as the previous embodiment of FIG. 1.

Figure 4:
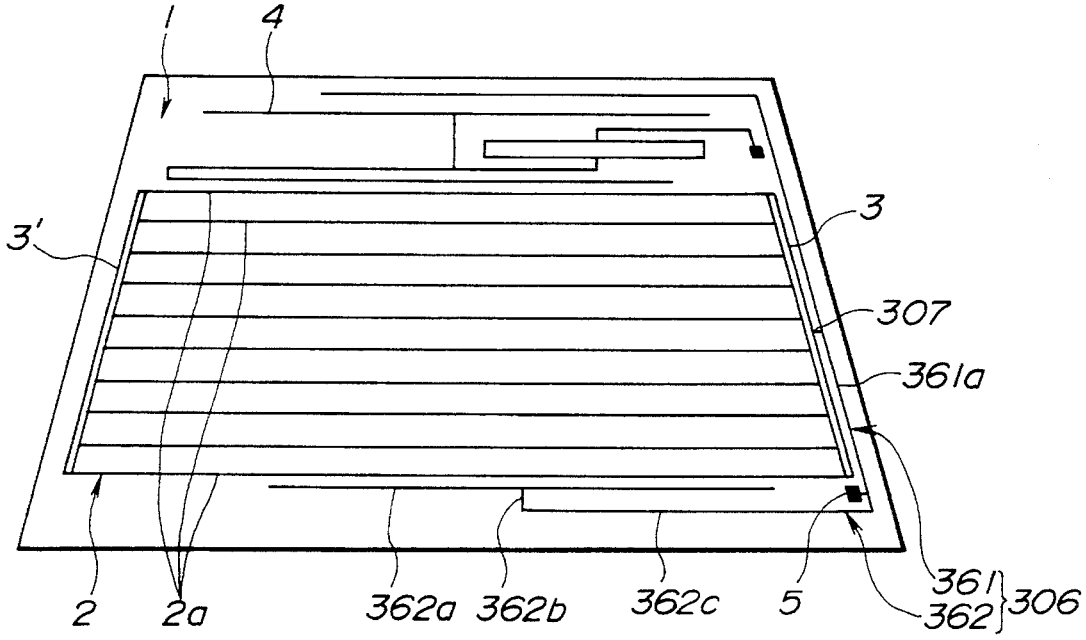

FIG. 4 shows a further embodiment which differs from the previous embodiment of FIG. 1 in that the second element 362 is made up of a horizontal conductive strip 362*a* of the length of 800 mm, a vertical conductive strip 362*b* of the length of 40 mm and connected at an upper end to the lengthwise center of the horizontal conductive strip 362*a* to constitute a T-shaped conductive strip assembly, and a generally horizontal conductive strip 362*c* extending between the lower end of the vertical conductive strip 361*b* and the feed point 5. The conductive strip 307 connects the bus bar 3 and the vertical conductive strip 361*a* of the first element 361.

With an automotive glass antenna such as that shown in FIG. 4, the gains in various directions with respect to an FM wave having a frequency of 60 MHz and a horizontal plane of polarization were measured and expressed by the above mentioned dipole ratio to represent the directivity characteristic. The result was that the average of gains in the seventy-two directions was −16.3 dB, and the minimum gain was −22.9 dB. This embodiment thus can function properly with respect to a radio wave from any direction and therefore can produce substantially the same effect as the previous embodiment of FIG. 1.

Figure 5:
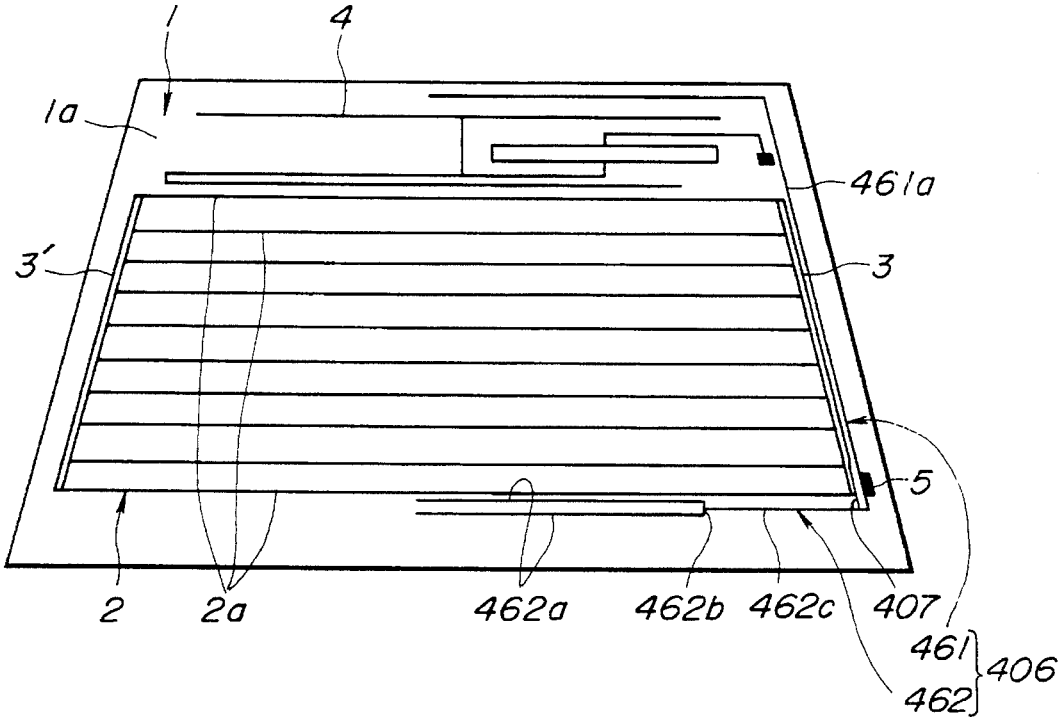

FIG. 5 shows a further embodiment which differs from the previous embodiment of FIG. 1 in that the bus bar 3 is partially made narrower adjacent the feed point 5 so that the feed point 5 is placed in a different position, i.e., on the side of the vertical conductive strip 461*a* of the first element 461 nearer to the lateral edge of the window glass 1. The second element 462 consists of a pair of first horizontal conductive strips 462*a* of the length of 450 mm, a vertical conductive strip 462*b* connecting one ends of the first horizontal conductive strips 462*a* and a second generally horizontal conductive strip 462*c* of the horizontal length of 250 mm and extending away from the vertical conductive strip 462*b* toward a lateral end of the window glass 1 to have an upwardly bent end where it is connected to the feed point 5, and the conductive strip 407 connects a part of the second element 462 located adjacent the feed point 5 to the bus bar 3.

With an automotive glass antenna such as that shown in FIG. 5, the gains in various directions with respect to an FM wave of a frequency of 250 MHz and having a horizontal plane of polarization were measured and expressed by the above mentioned dipole ratio to depict the directivity characteristic. The result was that the average of gains in the seventy-two directions was −15.7 dB, and the minimum gain was −23.5 dB. This embodiment thus can function properly with respect to a radio wave from any direction and therefore can produce substantially the same effect with the previous embodiment of FIG. 1.

Figure 6:
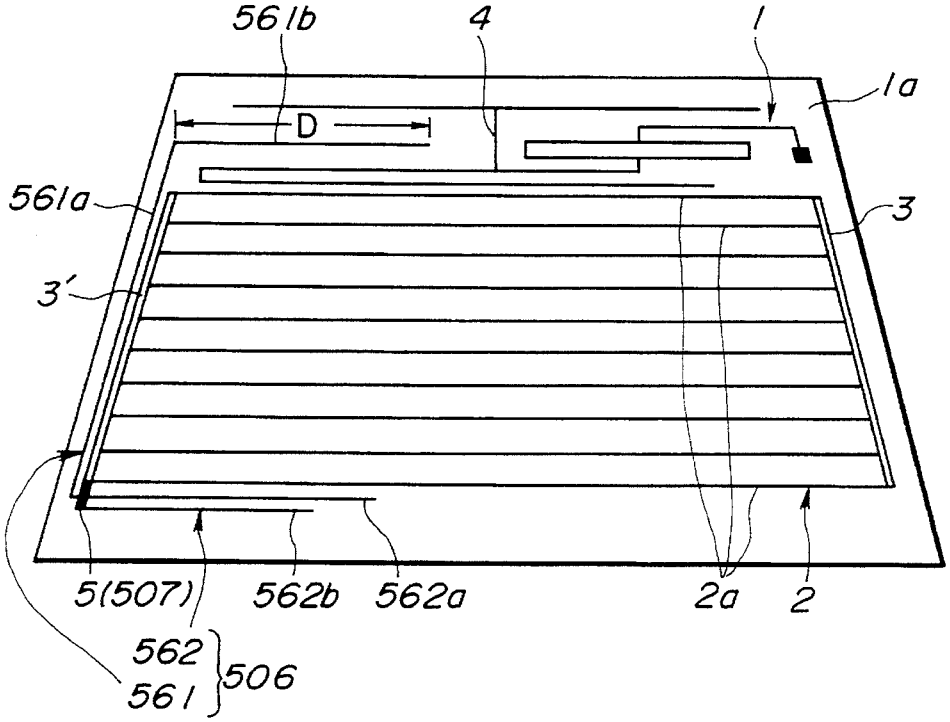

FIG. 6 shows a further embodiment in which the second antenna 506 is disposed on the opposite side of the window glass 1 as compared with the previous embodiments of FIGS. 1 to 5. The first element 561 is made up of a vertical conductive strip 561*a* arranged in an area of the space between the other bus bar 3' and a lateral edge of the window glass 1 and a horizontal conductive strip 561*b* which is not arranged in an area of the space 1*a* above the first antenna 4 but in an area of the space 1*a* defined by the first antenna 4, i.e., defined between the upper and lower ends of the first antenna 4. The other bus bar 3' has an extended lower end portion which constitutes or serves as both the feed point 5 and the conductive strip 507 for connection between the feed point 5 and the bus bar 3'. The first element 561 is sized such that D=400 mm. The second element 562 consists of two horizontal conductive strips 562*a* and 562*b* of different lengths, i.e., of the lengths of 400 mm and 300 mm, and connected to the feed point 5. Except for the above, this embodiment is substantially similar than the previous embodiment of FIG. 1.

With an automotive glass antenna such as that shown in FIG. 6, the gains in various directions with respect to FM wave of a frequency of 350 MHz and having a horizontal plane of polarization were measured and expressed by the above mentioned dipole ratio to depict the directivity characteristic. The result was that the average of gains in the seventy-two directions was −16.1 dB, and the minimum gain was −22.6 dB. This embodiment thus can function properly with respect to a radio wave from any direction and therefore can produce substantially the same effect as the previous embodiment of FIG. 1.

Figure 7:
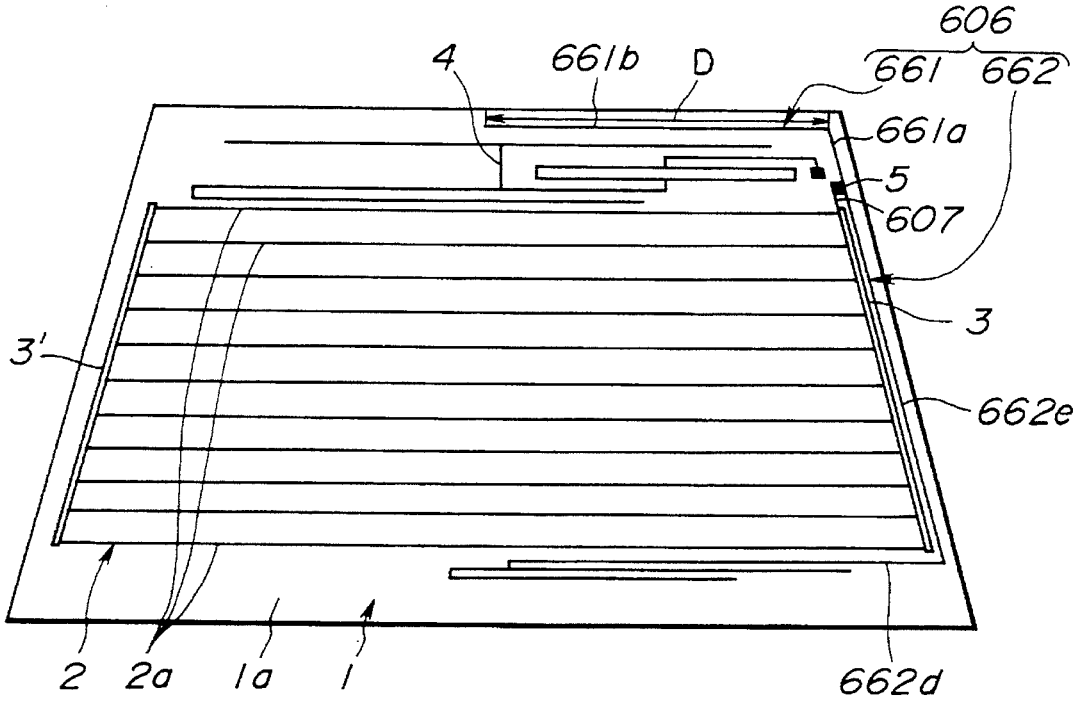

FIG. 7 shows a further embodiment which differs from the previous embodiment of FIG. 1 in that the feed point 5 is arranged in a widthwise marginal area of the space 1*a* above the heater element 2, i.e., in an area of the space 1*a* above the bus bar 3, the length D of the horizontal conductive strip 661*b* of the first element 661 is 500 mm, the vertical conductive strip 661*a* of the first element 661 is made shorter, the second element 662 has a vertical conductive strip 662*e* arranged in an area of the space between the defogging heater element 2 and the lateral edge of the window glass 1 and connected at an upper end to the feed point 5 and at the lower end to the generally horizontal conductive strip 662*d*.

With an automotive glass antenna such as that shown in FIG. 7, the gains in various directions with respect to FM wave of a frequency of 60 MHz and having a horizontal plane of polarization were measured and expressed by the above mentioned dipole ratio to represent the directivity characteristic. The result was that all the gains measured every five degrees (i.e., in the seventy-two directions) were larger than −25 dB (minimum gain was −20.8 dB), and the average of the gains in the seventy-two directions were −14.8 dB. This embodiment thus can function properly with respect to a radio wave from any direction and therefore can produce substantially the same effect as the previous embodiment of FIG. 1.

Figure 8:
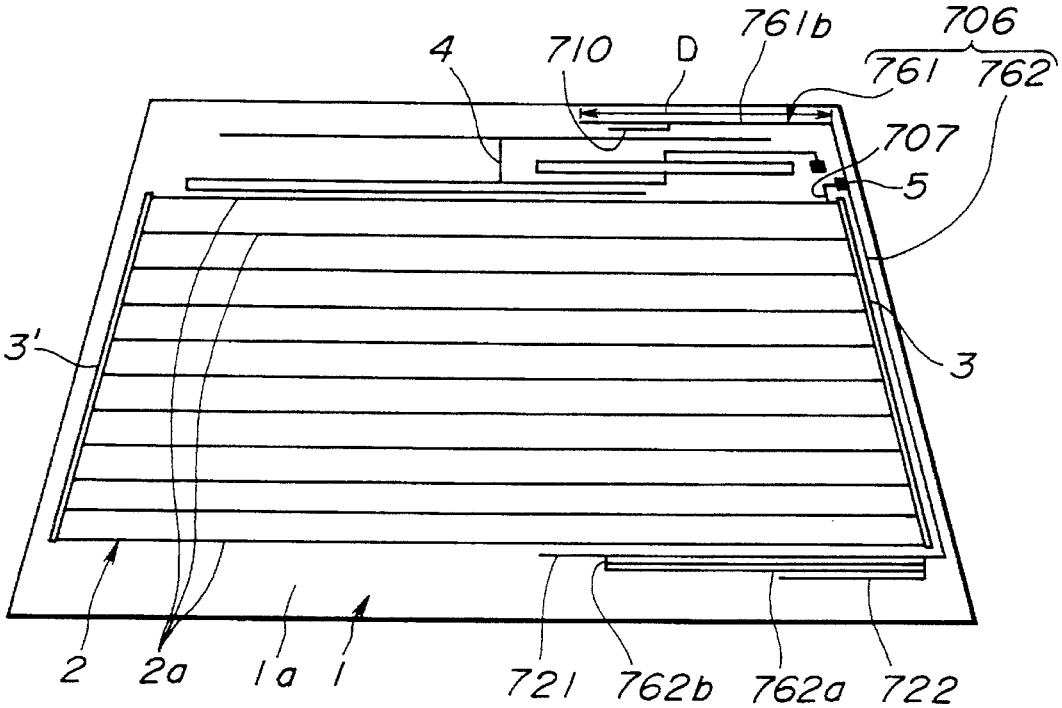

FIG. 8 shows a further embodiment which differs from the previous embodiment of FIG. 7 in that the length D of the horizontal conductive strip 761*b* of the first element 761 is 400 mm, the first element 761 further includes an auxiliary element 710 made up of a generally horizontal conductive strip of the horizontal length of 100 mm and having an upwardly bent end where it is connected to the horizontal conductive strip 761*b*, the second element 762 includes three horizontal conductive strips 762*a* of the length of 400 mm and arranged at vertical intervals of 10 mm, and vertical conductive strips 762*b* connecting the opposite ends of the horizontal conductive strips 762*a* to constitute two rectangular loops which are vertically continuous to each other, and the second element 762 further includes a first auxiliary element 721 made up of a horizontal conductive strip of the length of 100 mm and connected to the looped conductive strip assembly 762*a* and 762*b*. A second auxiliary element 722 is made up of a generally horizontal conductive strip having a horizontal length of 200 mm and has adjacent a lateral end of the window glass 1, an upwardly bent end where it is connected to the looped conductive strip assembly 762*a* and 762*b*, and the conductive strip 707 connects the feed point 5 to one of the heating strips 2*a* of the heater element 2 at its portion located adjacent the feed point 5.

With an automotive glass antenna such as that shown in FIG. 8, the gains in various directions with respect to an FM wave of a frequency of 250 MHz and having a horizontal plane of polarization were measured and expressed by the above mentioned dipole ratio to represent the directivity characteristic. The result was that all the gains measured every five degrees (i.e., in the seventy-two directions) were larger than −25 dB (minimum gain was −20.8 dB), and the average of the gains in the seventy-two directions was −15.1 dB. This embodiment thus can function properly with respect to a radio wave from any direction and therefore can produce substantially the same effect as the previous embodiment of FIG. 1.

Figure 9:
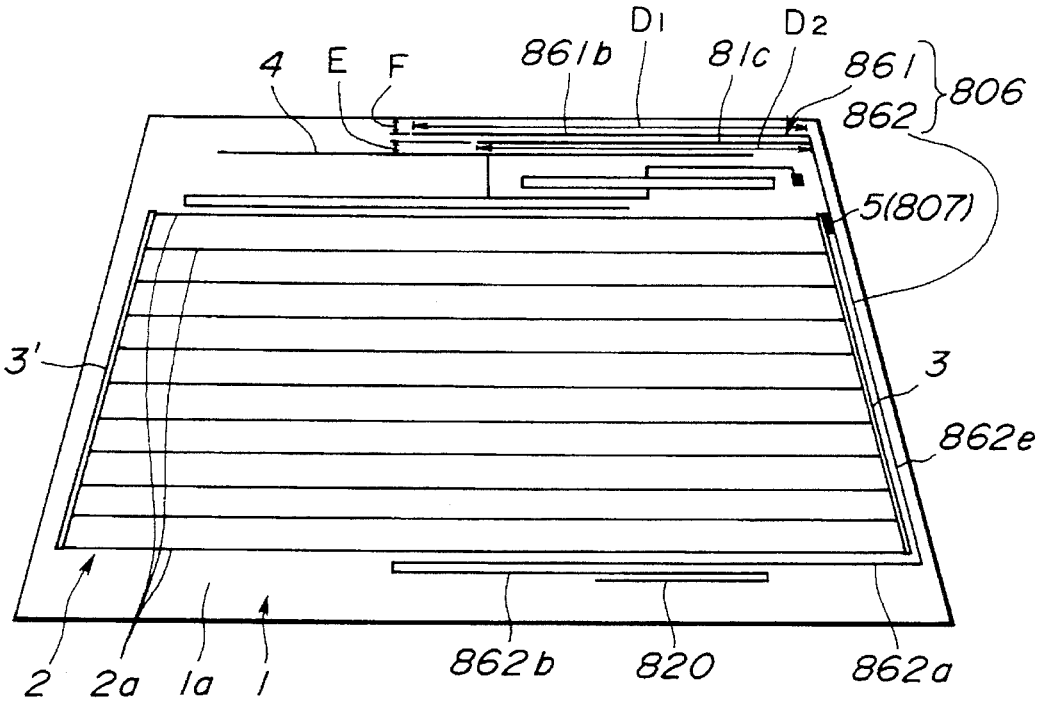

FIG. 9 shows a further embodiment which differs from the previous embodiment of FIG. 7 in that the bus bar 3 is made partially larger in width, i.e., the upper end portion of the bus bar 3 is made larger so as to constitute both the feed point 5 and the conductive strip 807 for connection between the feed point 5 and the bus bar 3. The length D1 of the horizontal conductive strip 861*b* of the first element 861 is 600 mm. The first element 861 further includes an auxiliary element 810 made up of a horizontal conductive strip having a length D2 of 500 mm. The horizontal conductive strip 861*b* and the auxiliary element 810 are arranged such that E=15 mm and F=15 mm. The second element 862 consists of a first generally horizontal conductive strip 862*a* of a horizontal length of 800 mm, connected to the lower end of the vertical conductive strip 862*e* and extending away therefrom toward the widthwise center of the window glass 1 to have a downwardly bent end. A second generally horizontal conductive strip 862*b* has horizontal length of 600 mm and is connected to the downwardly bent end of the first generally horizontal conductive strip 862*a* and extends away therefrom toward a lateral end of the window glass 1 to have a downwardly bent end. The second element 862 further includes an auxiliary element 820 made up of a horizontal conductive strip of the length of 200 mm and connected to the downwardly bent end of the second generally horizontal conductive strip 862*b*.

With an automotive glass antenna such as that shown in FIG. 9, the gains in various directions with respect to an FM wave of a frequency of 60 MHz and having a horizontal plane of polarization were measured and expressed by the above mentioned dipole ratio to depict the directivity characteristic. The result was that the average of gains in the seventy-two directions was −14.6 dB, and the minimum gain was −19.8 dB. This embodiment thus can function properly with respect to a radio wave from any direction and therefore can produce substantially the same effect with the previous embodiment of FIG. 1.

Figure 10:
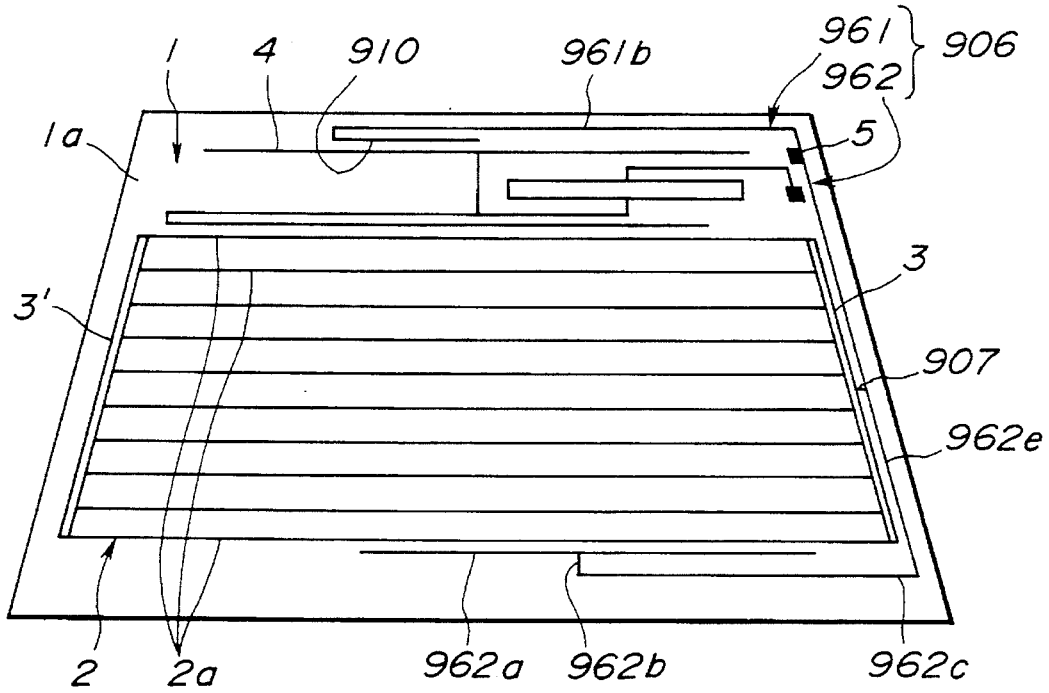

FIG. 10 shows a further embodiment which differs from the previous embodiment of FIG. 7 in that the length of the horizontal conductive strip 961*b* of the first element 961 is 650 mm. The first element 961 further includes an auxiliary element 910 made up of a generally horizontal conductive strip having a horizontal length of 200 mm and connected at an upwardly bent end to the horizontal conductive strip 961*b*. The second element 962 is made up of a horizontal conductive strip 962*a* having a length of 700 mm. A vertical conductive strip 962*b* having a length of 20 mm is connected at an upper end to the lengthwise center of the horizontal conductive strip 962*a* to constitute a T-shaped conductive strip assembly. A generally horizontal conductive strip 962*c* extends between the T-shaped conductive strip assembly and the lower end of the vertical conductive strip 962*e*, and the conductive strip 907 connects the bus bar 3' to the second element 962.

With an automotive glass antenna such as that shown in FIG. 10, the gains in various directions with respect to an FM wave of a frequency of 60 MHz and having a horizontal plane of polarization were measured and expressed by the above mentioned dipole ratio to depict the directivity characteristic. The result was that the average of gains in the seventy-two directions was −15.6 dB, and the minimum gain was −21.1 dB. This embodiment thus can function properly with respect to a radio wave from any direction and therefore can produce substantially the same effect as the previous embodiment of FIG. 1.

Figure 11:
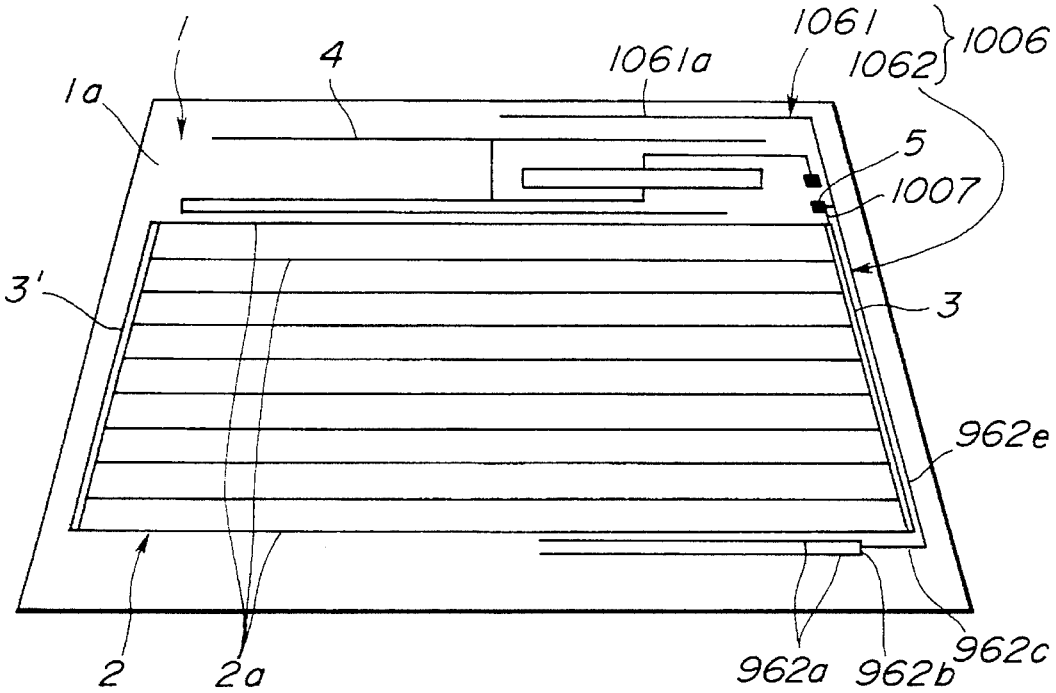

FIG. 11 shows a further embodiment which differs from the previous embodiment of FIG. 7 in that the length of the horizontal conductive strip 1061*a* of the first element 1061 is 480 mm, the conductive strip 1007 connects the feed point 5 to the bus bar 3, and the second element 1062 consists of a pair of first horizontal conductive strips 962*a* of the a length of 500 mm. A vertical conductive strip 962*b* connects first ends of the first horizontal conductive strips 962*a* and a second horizontal conductive strip 962*c* of the horizontal length of 80 mm and extending between the vertical conductive strip 962*b* and the lower end of the vertical conductive strip 962*e*.

With such an automotive glass antenna of FIG. 11, the gains in various directions with respect to an FM wave of a frequency of 250 MHz and having a horizontal plane of polarization were measured and expressed by the above mentioned dipole ratio to depict the directivity characteristic. The result was that the average of gains in the seventy-two directions was −15.3 dB, and the minimum gain was −20.3 dB. This embodiment thus can function properly with respect to a radio wave from any direction and therefore can produce substantially the same effect as the previous embodiment of FIG. 1.

Figure 12:
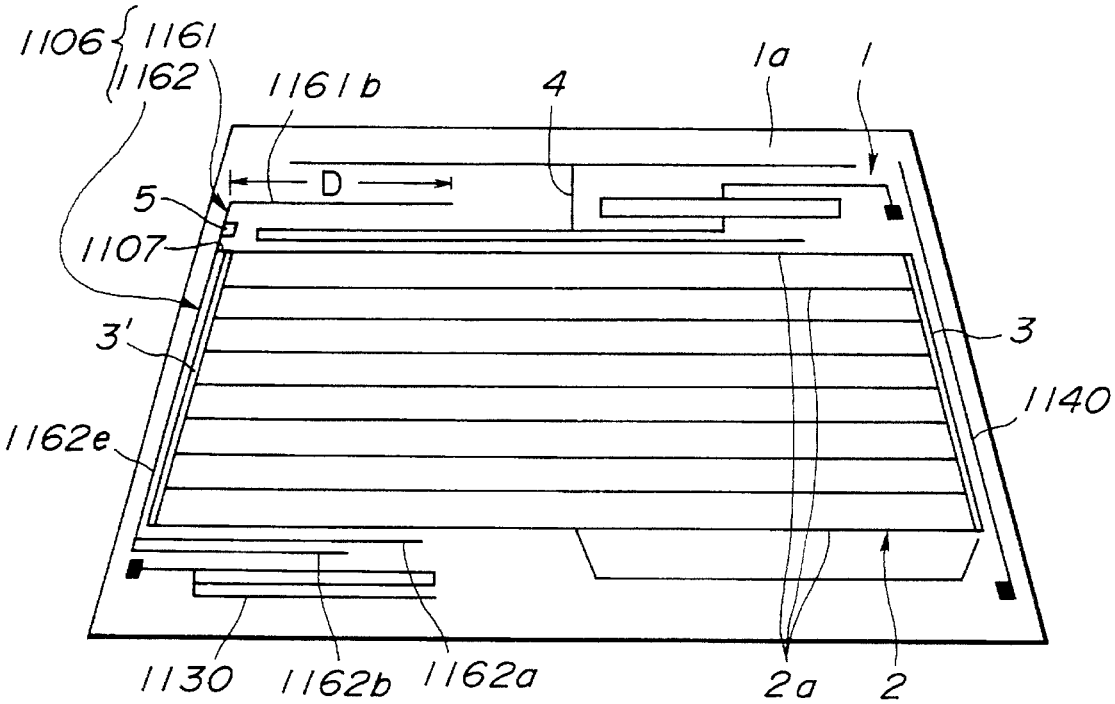

FIG. 12 shows a further embodiment in which the second antenna 1106 is disposed on the opposite side of the window glass 1 as compared with the previous embodiments of FIGS. 7 to 11. The first element 1161 includes a horizontal conductive strip 1161*b* with a length D of 350 mm, which is not arranged in an area of the space 1*a* above the first antenna 4 but in an area of the space 1*a* defined by the first antenna 4, i.e., defined between the upper and lower ends of the first antenna 4. The second element 1162 includes a vertical conductive strip 1162*e* arranged in an area of the space between the other bus bar 3' and a lateral edge of the window glass 1. The second element 1162 further includes two horizontal conductive strips 1162*a* and 1162*b* of the different lengths, i.e., of lengths of 400 mm and 300 mm, and connected to the lower end of the vertical conductive strip 1162*e*. Except for the above, this embodiment is substantially similar to the previous embodiment of FIG. 7.

With an automotive glass antenna such as that shown in FIG. 12, the gains in various directions with respect to FM waves of a frequency of 350 MHz and having a horizontal plane of polarization were measured and expressed by the above mentioned dipole ratio to depict the directivity characteristic. The result was that the average of gains in the seventy-two directions was −15.4 dB, and the minimum gain was −20.9 dB. This embodiment thus can function properly with respect to a radio wave from any direction and therefore can produce substantially the same effect as the previous embodiment of FIG. 1.

In FIG. 12, indicated by 1130 is a third antenna and indicated by 1140 is a fourth antenna. When such third and fourth antennas 1130 and 1140 are provided, it is particularly desirable to arrange the feed point 5 above the heater element 2 since, by this arrangement, difficult work caused in wiring of the antennas can be avoided.

While the present invention has been described and shown as above, various modifications and variations may be made thereto.

For example, the first antenna is not limited to what has been described and shown but may be of various different types.

Further, the first element constituting the second antenna may be made up of one or two horizontal conductive strips and the length D or lengths D1, D2 thereof can be variably set within the range of 150 mm to 700 mm.

With regard to the second element of the second antenna in the embodiments of FIGS. 1 and 7, the lengths of the two horizontal conductive strips of the second element can be variably set within the range from 300 mm to 1300 mm, and the length of the vertical conductive strip connecting one ends of the two horizontal conductive strip can be variably set within the range from 5 to 30 mm. The distance M between the generally horizontal conductive strip and the lowest heating strip of the heater element is desirably in the range from 5 to 30 mm, so the vertical length K is set so as to attain the desired distance M.

With regard to the second element in the embodiments of 2 and 8, a loop or loops can be formed from two to four horizontal conductive strips, and the lengths of the horizontal conductive strips can be variably set within the range of $0.02\ \lambda \cdot f^{1/2}\ (1\pm0.2)$ where f is the frequency of radio wave to be received by the antenna and $\lambda$ is the wavelength of the radio wave. When the horizontal length is set within the range from 320 mm±65 mm, the antenna can function properly with respect to a radio frequency signal of a frequency around 350 MHz. When the horizontal length is set within the range from 780 μm±150 mm, the antenna can function properly with respect to a radio frequency signal of a frequency around 60 MHz.

With regard to the second element in the embodiments of FIGS. 3 and 9, the horizontal length of the first generally horizontal conductive strip extending away from the feed point can be variably set within the range from 400 mm to 1200 mm and preferably within the range from 500 mm to 1000 mm, and the second generally horizontal conductive strip extending away from the bent end of the first generally horizontal conductive strip toward the feed point can be set variably within the range from 200 mm to the horizontal length of the first generally horizontal conductive strip and depending upon the type of vehicle.

With regard to the second element in the embodiments of FIGS. 4 and 10, the total length of the first horizontal conductive strip and the second generally horizontal conductive strip can be suitably set within the range from 200 mm to 1000 mm and preferably within the range from 400 mm to 800 mm, and the length of the vertical conductive strip can be suitably set within the range from 5 mm to 50 mm.

With regard to the second elements in the embodiments of FIGS. 5 and 11, the length of the horizontal conductive strips forming a ⊐-shape can be variably set within the range from 300 mm to 700 mm, and the length of the vertical conductive strip forming ⊐-shape can be variably set within the range from 10 mm to 50 mm. The number of the horizontal conductive strips can be variably set within the range from 2 to 4.

With regard to the embodiments of FIGS. 6 and 12, the second element can be constituted by the horizontal conductive strips only.

The distance N between the vertical conductive strip of the first element and the bus bar should be 2 mm or more and preferably 5 mm or more. The distance O between the vertical conductive strip of the first element and the lateral edge of the glass plate should be 10 mm or more and preferably 15 mm or more so that adhesive or bond for attachment of the window glass can be applied to the marginal area between the vertical conductive strip and the lateral edge of the window glass.

The auxiliary elements which have been described and shown are not always necessitated but various kinds of auxiliary elements such as a rectangular, L-shaped, ⊐-shaped or T-shaped auxiliary element can be used with a view to improving the directivity characteristic and increasing the gain.

While the glass antenna of this invention, when used in a keyless entry system for receiving a radio frequency signal of a frequency around 60 MHz, 250 MHz and 350 MHz, is for exclusive use therefor, it can otherwise be used as a subsidiary antenna for Japanese FM radio broadcast wave of the frequency ranging from 76 MHz to 90 MHz, North American FM radio broadcast wave of the frequency ranging from 88 MHz to 108 MHz, Japanese TV broadcast wave of the frequency ranging from 90 MHz to 108 MHz and from 170 MHz and 222 MHz, etc. In such a case, a more desirable result can be obtained when the antenna of this invention is used together with a main antenna constituted by a glass antenna provided to the upper portion of the glass plate above the defogging heater element, a glass antenna provided to the windshield, a glass antenna provided to the glass pane of the side window, a glass antenna provided to the glass pane of the side window or a pole antenna to perform diverse reception.

Further, if the rear window glass is made up of a laminated glass, the glass antenna can be formed from thin metal wire such as copper wire which is embedded in an intermediate layer of polyvinyl butyral.

What is claimed is:

1. An antenna system attached to a vehicle rear window glass for receiving radio waves, the window glass being provided with a defogging heater element so as to leave a space around the heater element, the antenna system comprising:

a first antenna arranged in an area of said space above the defogging heater element and having a horizontal conductive strip and a vertical conductive strip;

a second antenna having a feed point arranged in a widthwise marginal area of said space under the defogging heater element, and a pair of first and second elements connected to said feed point;

said first element having a vertical conductive strip arranged in an area of said space between the defogging heater element and a lateral edge of the window glass, and a horizontal conductive strip arranged in an area of said space above the first antenna;

said second element being arranged in an area of said space under the defogging heater element; and conductive strip means for providing electrical connection between the defogging heater element and said second antenna.

2. An antenna system attached to a vehicle rear window glass for receiving radio waves, the window glass being provided with a defogging heater element so as to leave a space around the heater element, the antenna system comprising:

a first antenna arranged in an area of said space above the defogging heater element and having a horizontal conductive strip and a vertical conductive strip;

a second antenna having a feed point arranged in a widthwise marginal area of said space above the defogging heater element, and a pair of first and second elements connected to said feed point;

said first element having a horizontal conductive strip arranged in an area of said space above the first antenna;

said second element having a vertical conductive strip arranged in an area of said space between the defogging heater element and a lateral edge of the window glass, and a horizontal conductive strip arranged in an area of said space under the defogging heater element; and conductive strip means for providing electrical connection between the defogging first antenna and said second antenna.

3. The antenna system according to claim 1 or 2, wherein said second element comprises a pair of horizontal conductive strips, a vertical conductive strip connecting first ends of said horizontal conductive strip of said second element, and a generally horizontal conductive strip extending upward from one of said horizontal conductive strips of said second element and extending horizontally toward a lateral end of the window glass.

4. The antenna system according to claim 1 or 2, wherein said second element comprises a plurality of horizontal conductive strips having the length of $0.02\ \lambda \cdot f^{1/2}\ (1 \pm 0.2)$ where f is the frequency of radio wave to be received by the antenna and $\lambda$ is the wavelength of the radio wave, the number of horizontal conductive strips being in the range from two to four, and adjacent horizontal conductive strips being connected at opposite ends by vertical conductive strips so as to constitute a rectangular loop.

5. The antenna system according to claim 1 or 2, wherein said second element comprises a first generally horizontal conductive strip connected to said feed point and extending horizontally away therefrom so as to have a bent end, a second generally horizontal conductive strip connected to said bent end of said first horizontal conductive strip of said second element and extending horizontally toward a lateral end of the window glass.

6. The antenna system according to claim 1 or 2, wherein said conductive strip means comprises a conductive strip extending between a bus bar of the heater element and said second antenna to provide electrical connection therebetween.

7. The antenna system according to claim 1 or 2, wherein said conductive strip means comprises a conductive strip extending between a lowest heating strip of the heater element and said second antenna to provide electrical connection therebetween.

8. The antenna system according to claim 1 or 2, wherein said conductive strip means comprises a conductive strip extending between the defogging heater element and said feed point of said second antenna to provide electrical connection therebetween.

9. The antenna system according to claim 1 or 2, wherein said conductive strip means comprises a conductive strip extending between the defogging heater element and said first element of said second antenna to provide electrical connection therebetween.

10. The antenna system according to claim 1 or 2, wherein a smallest distance between said first antenna and said first element is no less than 15 mm.

11. The antenna system according to claim 1 or 2, wherein a smallest distance between said first element and an upper edge of the window glass is no less than 10 mm.

* * * * *